US010124400B2

(12) United States Patent
Veevers

(10) Patent No.: US 10,124,400 B2
(45) Date of Patent: Nov. 13, 2018

(54) CASTING DIE

(71) Applicant: ROLLS-ROYCE PLC, London (GB)

(72) Inventor: Christopher R Veevers, Derby (GB)

(73) Assignee: ROLLS-ROYCE plc, London (GB)

( * ) Notice: Subject to any disclaimer, the term of this patent is extended or adjusted under 35 U.S.C. 154(b) by 250 days.

(21) Appl. No.: 15/155,667

(22) Filed: May 16, 2016

(65) Prior Publication Data

US 2016/0339508 A1 Nov. 24, 2016

(30) Foreign Application Priority Data

May 22, 2015 (GB) ..... 1508791.9

(51) Int. Cl.

| | |
|---|---|
| ***B22C 9/06*** | (2006.01) |
| ***B22D 17/22*** | (2006.01) |
| ***B21K 3/04*** | (2006.01) |
| ***B21K 5/20*** | (2006.01) |

(52) U.S. Cl.

CPC ..... *B22C 9/06* (2013.01); *B21K 3/04* (2013.01); *B21K 5/20* (2013.01); *B22D 17/22* (2013.01)

(58) Field of Classification Search

CPC ..... B21K 5/20; B22C 9/06; B22D 18/02

See application file for complete search history.

(56) References Cited

U.S. PATENT DOCUMENTS

2005/0199031 A1 9/2005 Hammar

FOREIGN PATENT DOCUMENTS

| | | | |
|---|---|---|---|
| DE | 102006008359 | A1 | 8/2007 |
| DE | 102011111583 | A1 | 2/2013 |
| EP | 1500445 | A2 | 1/2005 |
| JP | H01-262029 | A | 10/1989 |
| JP | H11-151530 | A | 6/1999 |

OTHER PUBLICATIONS

Apr. 7, 2016 Search Report issued in British Patent Application No. 1508791.9.

*Primary Examiner* — James Sanders
(74) *Attorney, Agent, or Firm* — Oliff PLC

(57) ABSTRACT

The present invention provides a casting/hot forging die having a forming surface and an opposing rear surface. The rear surface has a plurality of cavities spaced by a plurality of walls. Each of the plurality of walls has a substantially equal width. At least one transverse wall may also be provided such that the walls define a grid spacing a series of rectangular or triangular cavities.

12 Claims, 5 Drawing Sheets

CASTING DIE

FIELD OF THE INVENTION

The present invention relates to a die for use in die casting or hot forging of components e.g. components such as aerofoils for gas turbine engines.

BACKGROUND OF THE INVENTION

Components such as aerofoils for gas turbines engines are typically super plastically formed in a die cavity which is defined by two opposing dies. Each die has a forming surface 1 which shapes the material into the desired component form (as shown in FIG. 1*a*) and an opposing rear surface 2 (as shown in FIG. 1*b*).

Cavities 3 are typically formed into the rear surface 2 of the die in order to reduce the thermal mass of the die which, in turn, reduces cooling of the furnace upon introduction of the die and reduces heat retention by the die after removal from the furnace.

The cavities 3 in the rear surface 2 of the die are typically separated by a plurality of walls 4 (as shown in FIG. 1*d*). The walls help increase the strength of the die to allow it to withstand press forces. The walls typically differ in width/thickness, in some cases by up to 50%. The thickness of the die at the base 5 of the cavities 4 also differs (as shown in FIG. 1*c*). The walls are constructed so that several different component dies take up a similar space and will therefore fit a single press without changing the position or stroke of the press.

Although not explicitly shown in the FIGS. 1*a-d*, additional pockets or projections may be formed into the rear surface of the die to act as fixture/guide features to ensure accurate location of the die within the furnace and/or against the opposing die(s).

The variation in the thickness of the die/walls leads to thermal and contraction stresses which can reduce the life of the die and, over time and cycles lead to distortion of the die which, in turn can lead to undesirable variation in the shape of the cast or forged component.

There is a desire for a die, for use in die casting or hot forging, which has an increased life and reduces undesirable variation in the shape of the cast component and thus reduces the need for/extent of post-casting or post-forging machining.

SUMMARY OF THE INVENTION

In a first aspect, the present invention provides a die having a forming surface and an opposing rear surface, the rear surface having a plurality of cavities spaced by a plurality of walls, wherein the plurality of walls all have a substantially equal width.

By providing walls having an equal/uniform width to space the cavities in the rear surface, thermal and contraction stresses are reduced thus allowing the cast component to be manufactured nearer to net-shape such that material usage is reduced and the cast/forged component requires less machining.

Optional features of the invention will now be set out. These are applicable singly or in any combination with any aspect of the invention.

Reference to the width of the walls is intended to refer to the dimension perpendicular to the axial extension (length) of the walls (in the plane of the rear surface). This also represents the spacing between adjacent cavities and the equal width of the walls results in an equal spacing between each cavity and its adjacent cavity/cavities.

The die typically has a width and a (typically longer) length dimension.

Each of the plurality of walls may have an axial extension coincident with the width dimension of the die.

Each of the plurality of walls may have an axial extension coincident with the length dimension of the die.

The cavities may additionally be spaced by one or more transverse walls.

Each transverse wall may have a width substantially matching the width of each of the plurality of walls.

The transverse walls may have an axial extension perpendicular to the axial extension of the plurality of walls. In some embodiments, each of the plurality of walls has an axial extension coincident with the width dimension of the die and the cavities are further spaced by at least one transverse wall having an axial extension perpendicular to the axial extension of the plurality of walls i.e. coincident with the length dimension of the die.

In some embodiments, the cavities have a substantially rectangular/square cross-section profile i.e. the plurality of walls and transverse wall(s) define a grid spacing a plurality of rectangular cavities (e.g. square cavities).

The transverse walls may have an axial extension at an angle of less than 90 degrees e.g. substantially 60 degrees (or a multiple of substantially 60 degrees) to the axial extension of the plurality of walls. Two pairs of transverse walls may diverge away from a respective single point on a respective one of said plurality of walls such that said plurality of walls and said transverse walls define triangular or hexagonal cavities. The plurality of walls and transverse walls may define an isogrid pattern.

The die may comprise opposing lateral edge walls (having an axial extension coincident with the width of the die). The or both lateral edge walls may have a width substantially matching the width of each of the plurality of walls.

The die may comprise opposing transverse edge walls (having an axial extension coincident with the length of the die). The or both transverse edge walls may have a width substantially matching the width of each of the plurality of walls.

Each cavity in the rear face extends to a respective cavity base surface. In some embodiments, the distance through the die between the forming surface and the cavity base surface is uniform within each cavity.

In some embodiments, the distance through the die between the forming surface and the cavity base surface is uniform within all cavities.

In some embodiments, the distance through the die between the forming surface and the cavity base surface within each cavity/all cavities substantially matches the width of each of the plurality of walls.

In some embodiments, the cavity base surface in at least one of the cavities comprises a respective projection extending away from the respective cavity base surface towards the rear surface (in a direction coincident with the height of the plurality of walls). The or each projection is preferably positioned in the centre of the respective cavity base surface such that it is equally spaced from the walls/transverse walls/edge walls defining the respective cavity, the aim being to ensure even thermal growth and shrinkage factoring in the thermal mass of the component.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1A:
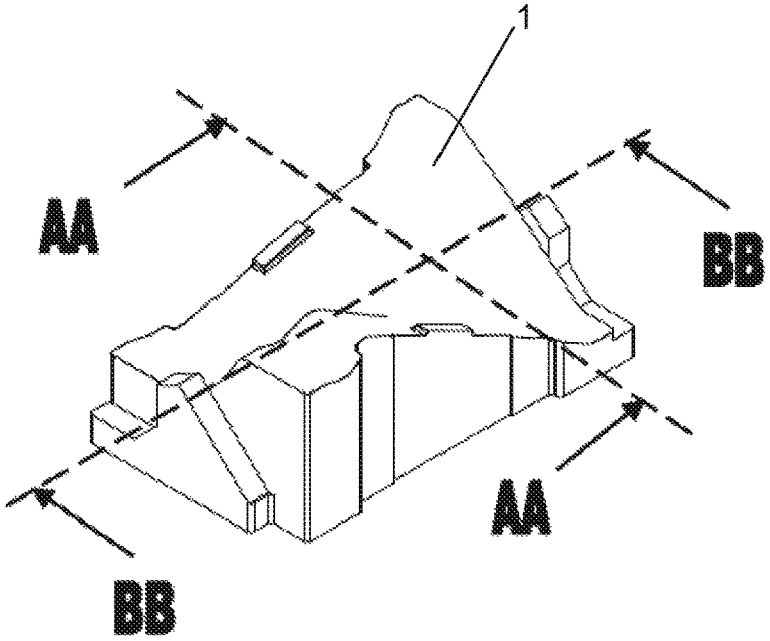
FIG. 1a Prior Art
FIG. 1*a* shows a perspective view of the forming surface of a prior art die.
Figure 1B:
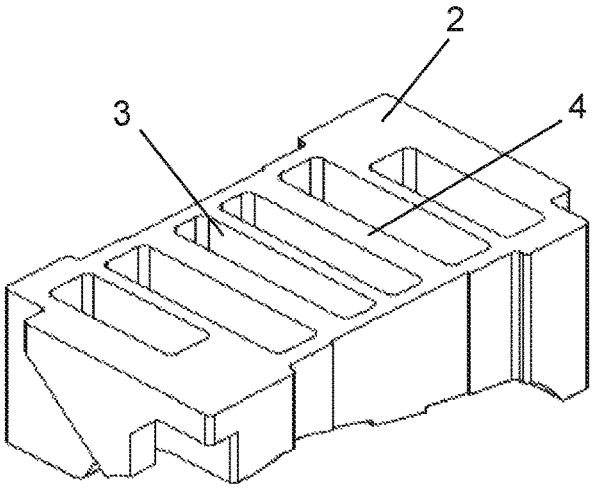
FIG. 1b Prior Art
FIG. 1*b* shows a perspective view of the rear surface of the prior art die.
Figure 1C:
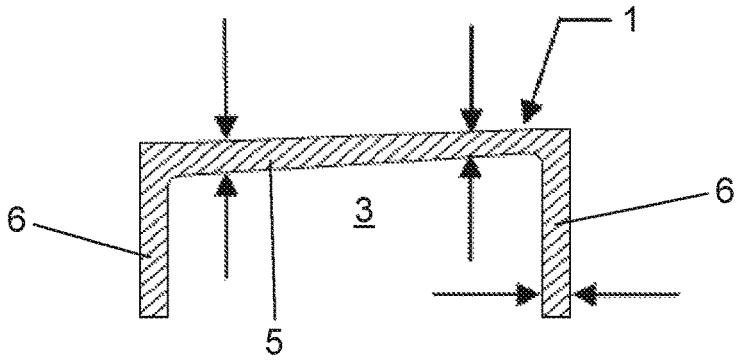
FIG. 1c Prior Art
FIG. 1*c* shows a cross-sectional view along line AA of the prior art die.
Figure 1D:
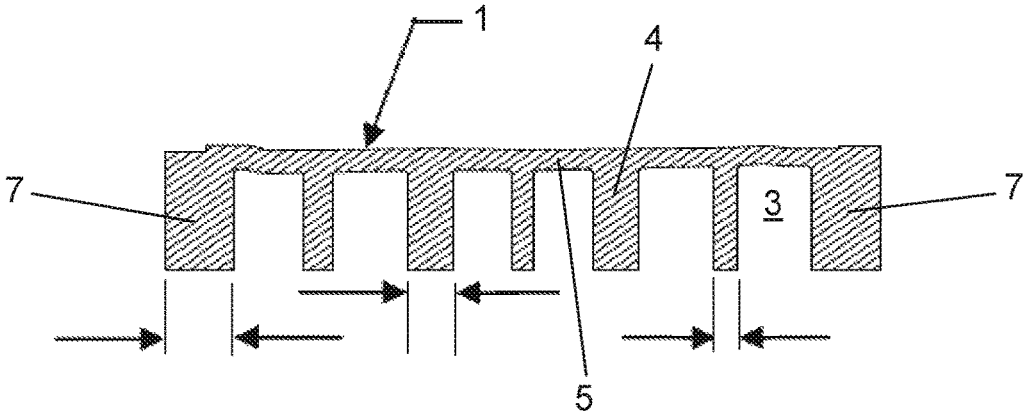
FIG. 1d Prior Art
FIG. 1*d* shows a cross-sectional view along line BB of the prior art die.

As shown in FIGS. 2*a-d*, a first embodiment of the present invention provides a casting die having a forming surface 1 and an opposing rear surface 2.

In use, the forming surface 1 is used to define one half of a mould cavity and to form superplastic or liquid material e.g. molten metal or metal in its plastic form into the shape desired for cast, forged, or superplastically formed component.

The rear surface has a width dimension (extending in the direction of line CC) and a longer length dimension (extending in the direction of line DD).

The rear surface has a plurality of rectangular cavities 3' defined and mutually spaced by walls 4 having an axial extension coincident with the width dimension of the die and a transverse wall 6 having an axial extension coincident with the length dimension of the die.

The die further comprises opposing lateral edge walls 7 (having an axial extension coincident with the width of the die) and opposing transverse edge walls 8 (having an axial extension coincident with the length of the die).

Figure 2A:
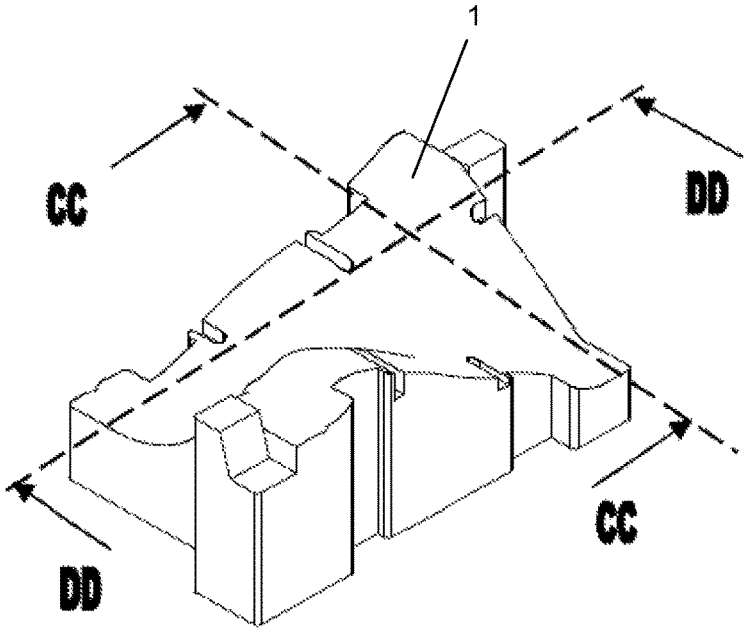
FIG. 2*a* shows a perspective view of the forming surface of a die according to a first embodiment of the present invention.
Figure 2B:
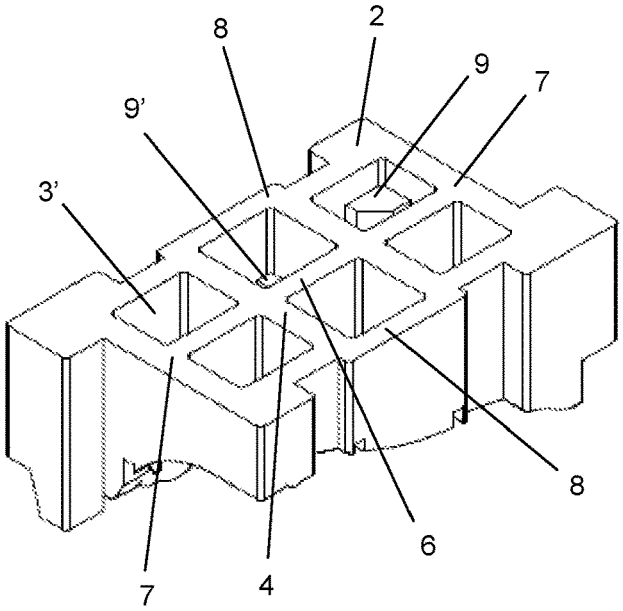
FIG. 2*b* shows a perspective view of the rear surface of the die according to the first embodiment of the present invention.
Figure 2C:
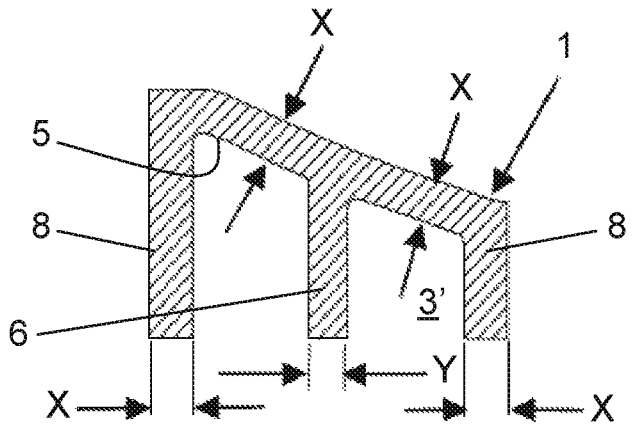
FIG. 2*c* shows a cross-sectional view along line AA of the die according to the first embodiment of the present invention.
Figure 2D:
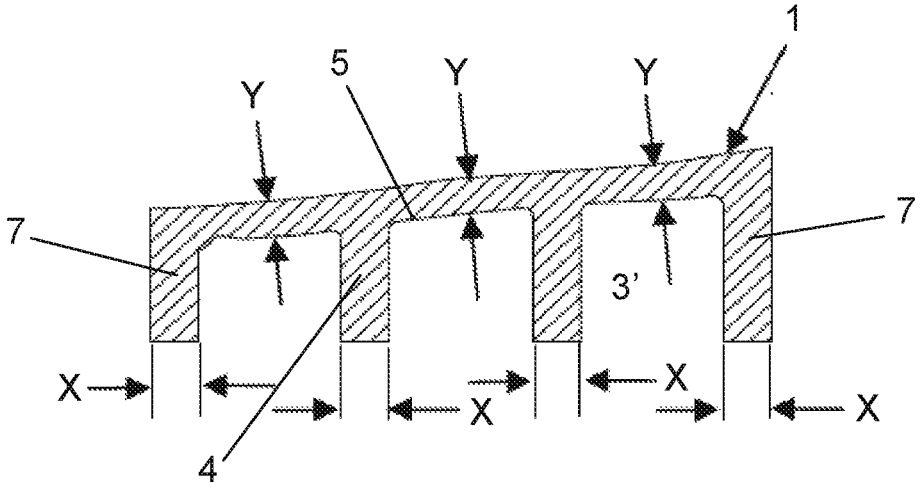
FIG. 2*d* shows a cross-sectional view along line BB of the die according to the first embodiment of the present invention.

As shown in FIGS. 2*c* and 2*d*, the walls 4, lateral edge walls 7 and transverse edge walls 8 all have an equal width x (the dimension perpendicular to the axial extension (length) of the walls 4 in the plane of the rear surface). The transverse wall 6 has a reduced width y which is about 75% of the width x. However, in other embodiments, the transverse wall 6 may have the same width x as the walls, 4, lateral edge walls 7 and transverse edge walls 8.

By providing walls having an equal/uniform width x and thus an equal spacing between each cavity 3' and its adjacent cavity, thermal and contraction stresses are reduced thus allowing the cast component to be manufactured nearer to net-shape such that material usage is reduced and the cast component requires less machining.

Each cavity 3' in the rear face 2 extends to a respective cavity base surface 5. As shown in FIGS. 2*c* and *d*, the distance through the die between the forming surface and the cavity base surface is uniform within all cavities and substantially matches the width x of each of the plurality of walls 4.

The cavity base surface 5 in two of the cavities 3' comprises a respective projection 9, 9' extending away from the respective cavity base surface 5 towards the rear surface 2 (in a direction coincident with the height of the plurality of walls 4). The projections are positioned in the centre of the respective cavity base surface 5 such that they are equally spaced from the walls 4/transverse wall 6/transverse edge walls 8/lateral edge walls 7 defining the respective cavity 3'.

These projections are for assisting easy location of the die within the furnace during the casting or forging process.

Figure 3:
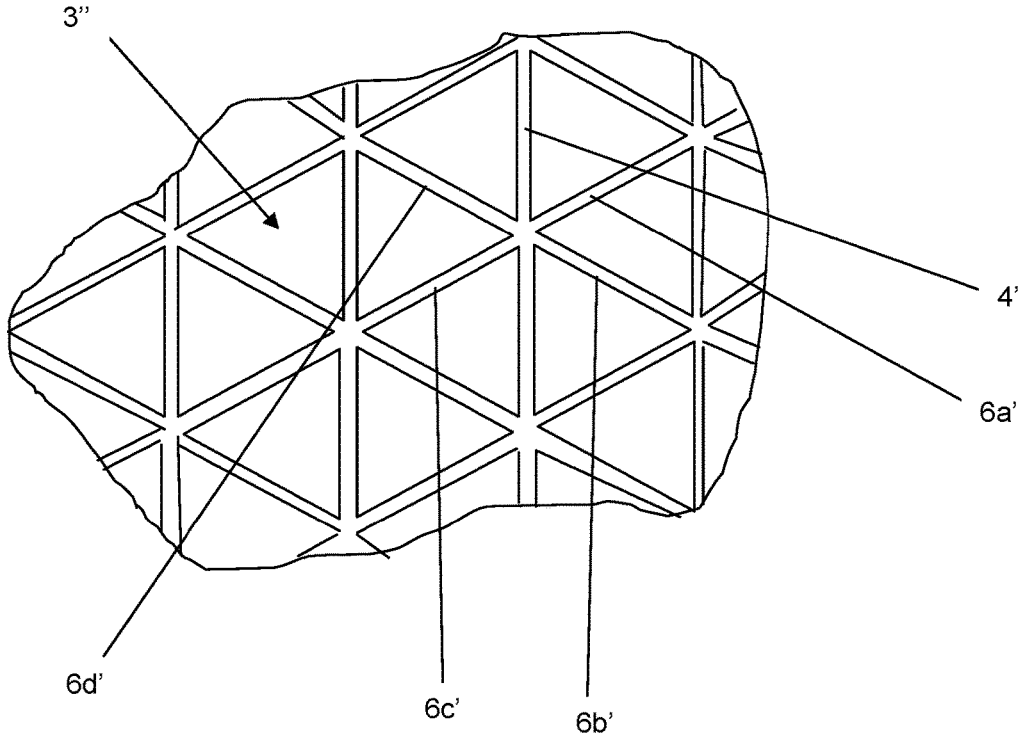
FIG. 3 shows a plan view of the rear surface of a die according to a second aspect of the present invention.

FIG. 3 shows a plan view of the rear surface of a casting die according to a second preferred embodiment.

The rear surface has a plurality of triangular cavities 3" defined and mutually spaced by walls 4' having an axial extension coincident with the width dimension of the die and transverse walls 6' having an axial extension at 60 degrees to the axial extension of the walls 4'.

Two pairs of transverse walls 6*a*'/6*b*' and 6*c*'/6*d*' diverge from a respective wall 4', angled at 60 degrees to the wall 4' to form an isogrid pattern defining the triangular cavities 3".

The walls 4' and transverse walls 6*a*'-6*d*' all have substantially the same width.

By providing walls having an equal/uniform width and thus an equal spacing between each cavity 3" and its adjacent cavity, thermal and contraction stresses are reduced thus allowing the component to be manufactured nearer to net-shape such that material usage is reduced and the component requires less machining.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A casting/hot forging die comprising:

a forming surface, and an opposing rear surface, the rear surface having a plurality of cavities spaced by a plurality of walls such that the plurality of walls all have a substantially equal width, wherein a cavity base surface in at least one of the cavities of the plurality of cavities includes a projection, the projection being positioned in a center of the cavity and extending away from the cavity base surface towards the rear surface.

2. The die according to claim 1 wherein each of the plurality of walls has an axial extension coincident with a width dimension of the die.

3. The die according to claim 1 further comprising one or more transverse walls that further define the cavities on the rear surface.

4. The die according to claim 3 wherein the one or more transverse walls each has a width substantially matching the width of each of the plurality of walls.

5. The die according to claim 1 wherein the transverse walls each has an axial extension perpendicular to the axial extension of the plurality of walls, and each cavity has a substantially square or rectangular cross-sectional profile.

6. The die according to claim 1 wherein the opposing rear surface further includes one or more transverse walls that each has an axial extension extending at substantially 60 degrees to an axial extension of the plurality of walls, and each cavity has a substantially triangular cross-sectional profile.

7. The die according to claim 1 further comprising opposing lateral edge walls such that at least one of the opposing lateral edge walls has a width substantially matching the width of each of the plurality of walls.

8. The die according to claim 1 further comprising opposing transverse edge walls such that at least one of the opposing transverse edges walls has a width substantially matching the width of each of the plurality of walls.

9. The die according to claim 1 wherein a distance through the die between the forming surface and the cavity base surface is uniform within each cavity.

10. The die according to claim 3, wherein a distance through the die between the forming surface and the cavity base surface is uniform within all cavities.

11. The die according to claim 9 wherein the distance through the die between the forming surface and the cavity base surface within each cavity substantially matches the width of each of the plurality of walls.

12. The die according to claim 1 wherein the projection is positioned in the center of the respective cavity base surface such that it is equally spaced from the walls defining the respective cavity.

* * * * *